US005093013A

United States Patent [19]

Sprague

[11] Patent Number: 5,093,013

[45] Date of Patent: Mar. 3, 1992

[54] OZONE FRIENDLY FIRE-EXTINGUISHING AGENTS

[75] Inventor: Lee G. Sprague, North Augusta, S.C.

[73] Assignee: Halocarbon Products Corporation, N. Augusta, S.C.

[21] Appl. No.: 448,781

[22] Filed: Dec. 11, 1989

[51] Int. Cl.[5] ..... A62D 1/08

[52] U.S. Cl. ..... 252/8; 252/2; 252/3; 169/11

[58] Field of Search ..... 252/2, 3, 8; 169/11

[56] References Cited

U.S. PATENT DOCUMENTS

| | | | |
|---|---|---|---|
| 1,103,092 | 7/1914 | Snelling | 252/8 |
| 3,276,999 | 10/1966 | Petit et al. | 252/8 |
| 3,609,074 | 9/1971 | Rainaldi | 252/3 |
| 3,657,120 | 4/1972 | Porst | 252/8 |

OTHER PUBLICATIONS

Chemical Abstract 102:187493c, "Effect of Halocarbons on the Flash Point", Meerlender et al. (Fed. Rep. Ger.), PTB-Mitt., 1984.

Chemical Abstract, 92:217611j, "Fire Extinguishing Compositions", ETAT Francais Fr., 1,605,545 (C1 A62D), 29 Jun. 1979, appl. date 1962.

Derwent Abstract, 80-75640c/43 (75640c), "Fire Extinguishing Compositions", ETAT Francais Fr., 1,605,545 (C1 A62D), 29 Jun. 1979, appl. date 1962.

Chemical Abstract, 113:214908c, "Fire Extinguishing Compositions", Fletcher, Norman (Imperial Chemical Ind. PLC), Eur. Pat. Appl., EP 383,443, 22 Aug. 1990.

Chemical Abstract, 71:93209d, "Flammability of Materials in Hyperbaric Atmospheres", Kuchta et al. (Explos. Res. Center, Bar. of Mines, PA.), 1967.

*Primary Examiner*—Robert L. Stoll
*Assistant Examiner*—Joseph D. Anthony
*Attorney, Agent, or Firm*—Sprung Horn Kramer & Woods

[57] ABSTRACT

In a fire extinguisher containing a halogenated hydrocarbon extinguishant, the improvement wherein said extinguishant comprises at least one of 2-bromo-1,1,1,2-tetrafluoroethane and 2-bromo-2-chloro-1,1,1-trifluoroethane. These compounds will eventually decompose in the atmosphere so as not to present a hazard to the ozone layer.

1 Claim, No Drawings

OZONE FRIENDLY FIRE-EXTINGUISHING AGENTS

The present invention relates to compositions for fire extinguishers which are ozone friendly, and to fire extinguishers loaded therewith.

A group of fully halogenated bromofluorocarbons known as halons are used as outstanding fire-extinguishing agents. Recently these compounds have been linked to the depletion of the stratospheric ozone layer and their production has been limited by the Montreal Protocol. Therefore, new fire-extinguishing agents are needed which are ozone friendly.

To be effective, an agent must have the correct combinations of extinguishant properties, atmospheric reactivity to prevent it reaching the stratosphere, boiling point, and ease of manufacture.

It has now been found that the compounds 2-bromo-1,1,1,2-tetrafluoroethane ($CF_3CHFBr$) and 2-bromo-2-chloro-1,1,1-trifluoroethane ($CF_3CHClBr$) are especially effective in performance as fire extinguishing agents and especially with regard to relatively rapid decomposition compared with other known halocarbons, especially those which are hydrogen-free.

These compounds are characterized by relatively high boiling points so that when sprayed onto a fire, as with a carbon dioxide or nitrogen propellant gas, they will reach the fire in the form of a cloud of vapor and liquid. This provides a greater opportunity for the agent to penetrate to the heart of a fire. Agents which are more volatile will be lost via evaporation before reaching the flames.

The following table compares the properties of these agents with Halon 1211, $CF_2ClBr$, presently in wide use in extinguishers:

| Agent | Boiling Point, °C. | Minimum Extinguishing Concentration |
|---|---|---|
| $CF_3CHFBr$ | 10 | 5.8 ± 0.5% |
| $CF_3CHClBr$ | 55 | 5.3 ± 1% |
| Halon 1211 | −4 | 5.1 ± 0.4% |

It is surprising that the presence of the hydrogen atom, which makes the compounds ozone friendly by imparting atmospheric oxidative reactivity, does not adversely affect their extinguishant property. The compounds while susceptible of combustion retain their valuable flame suppression characteristics.

These compounds are produced starting with trichloroethylene. Pursuant to U.S. Pat. No. 3,755,477, reaction of trichloroethylene and hydrogen fluoride gives $CF_3CH_2Cl$ (R-133a). This upon further reaction with hydrogen fluoride pursuant to U.S. Pat. No. 4,129,603 gives $CF_3CH_2F$ (R-134a). Such compounds are not especially effective in extinguishing fires because of the absence of bromine in the molecule. Accordingly, thermal or photochemical bromination of $CF_3CH_2Cl$ and $CF_3CH_2F$ gives $CF_3CHClBr$ and $CF_3CHFBr$, respectively. These are active in combating fires and, because of their hydrogen atoms, decompose so as not to build up in the atmosphere to the extent fully halogenated compounds do, e.g. the latter having half lives in excess of 100 years.

The active agents can be used in conventional manner, being filled into fire extinguishers as the fire-extinguishing liquid or gas. Advantageously a propellant such as carbon dioxide and/or nitrogen is also included, in conventional manner. In a preferred embodiment there can be employed a halocarbon, chlorine-free propellant in the extinguisher composition, e.g. $CF_4$ as described in U.S. Pat. No. 2,653,130, since it is nonflammable and ozone friendly. Such composition comprises the propellant $CF_4$ and the fire extinguishing compounds herein provided, formulated and used as described in U.S. Pat. No. 2,653,130. If desired, the active fire-extinguishing compounds may be mixed with other extinguishing compounds.

The preparation of the active materials is set forth in the following illustrative examples.

EXAMPLE 1

Preparation of 2-bromo-1,1,1,2-tetrafluoroethane

A 48"×1" OD glass tube, packed with glass Raschig rings and with a heated zone of 36", was mounted vertically and fitted with a constant addition funnel, a gas inlet port for R-134a addition and a thermowell. 1000 g of liquid bromine was dripped into the apparatus where it mixed with 681 g of R-134a (1064 sccm average flow) and percolated into the reaction zone maintained at 500° C. The effluent passed into a glass scrubbing bottle filled with 20% aq. NaOH, a silica gel drier, and condensed in a −78° C. glass trap. After washing and drying, 940 g of organic remained which contained 42% R-134a, 47% 2-bromo-1,1,1,2-tetrafluoroethane and 2% 2,2-dibromo-1,1,1,2-tetrafluoroethane. The product was purified by fractional distillation, bp 10° C.

EXAMPLE 2

2-Bromo-2-chloro-1,1,1-trifluoroethane

R-133a (1264 g) and bromine chloride (845 g) were mixed in a Monel feed bomb and pressured with nitrogen at 40 psig. The bomb was inverted and the contents were fed liquid phase to a glass tube (3 feet by 1 inch diameter) filled with glass helices and heated at 420° C. The feed rate was approximately 40 grams per hour. The effluent was collected in a trap at −78° C. The conversion of R-133a was 67% and the yield of 2-bromo-2-chloro-1,1,1-trifluoroethane was 66%.

It will be understood that the specification and examples are illustrative but not limitative of the present invention and that other embodiments within the spirit and scope of the invention will suggest themselves to those skilled in the art.

What is claimed is:

1. In a fire extinguisher containing a halogenated hydrocarbon extinguishant, the improvement wherein said extinguishant consists essentially of 2-bromo-1,1,1,2-tetrafluoroethane and is admixed with at least one of nitrogen, carbon dioxide and $CF_4$ as a propellant.

* * * * *